US009239188B2

(12) United States Patent
Adrian et al.

(10) Patent No.: US 9,239,188 B2
(45) **Date of Patent: *Jan. 19, 2016**

(54) SYSTEM AND METHOD FOR DRYING OF CERAMIC GREENWARE

(75) Inventors: Paul Andreas Adrian, Weselberg (DE); James Anthony Feldman, Campbell, NY (US); Michelle Yumiko Ronco, Horseheads, NY (US); Terri A Waschezyn, Elmira Heights, NY (US)

(73) Assignee: Corning Incorporated, Corning, NY (US)

( * ) Notice: Subject to any disclaimer, the term of this patent is extended or adjusted under 35 U.S.C. 154(b) by 1186 days.

This patent is subject to a terminal disclaimer.

(21) Appl. No.: 12/473,734

(22) Filed: May 28, 2009

(65) Prior Publication Data

US 2009/0294440 A1 Dec. 3, 2009

Related U.S. Application Data

(60) Provisional application No. 61/130,505, filed on May 30, 2008.

(51) Int. Cl.

| | |
|---|---|
| ***H05B 6/74*** | (2006.01) |
| ***F26B 3/347*** | (2006.01) |
| ***F26B 15/14*** | (2006.01) |

(52) U.S. Cl.

CPC ..... *F26B 3/347* (2013.01); *F26B 15/14* (2013.01); *F26B 2210/02* (2013.01)

(58) Field of Classification Search

CPC ..... H05B 6/80; H05B 6/68; H05B 6/78; H05B 6/6447; H05B 6/6435; H05B 2203/032; H05B 2206/046; H05B 6/62; H05B 6/64; F26B 3/347; F26B 2210/02; F26B 11/0495; F26B 23/04; F26B 25/22; F26B 5/048; F26B 13/10; F26B 15/00; F26B 5/042; F26B 15/14

USPC ..... 219/750, 700–702, 704, 705, 760–762, 219/392–398, 388, 518, 519; 34/215–217, 34/254–265, 418–426, 545

See application file for complete search history.

(56) References Cited

U.S. PATENT DOCUMENTS

| | | | | | |
|---|---|---|---|---|---|
| 3,446,929 | A | * | 5/1969 | Smith | 219/696 |
| 3,452,176 | A | * | 6/1969 | Levinson | 219/759 |
| 3,469,053 | A | * | 9/1969 | Levinson | 219/746 |
| 3,569,657 | A | * | 3/1971 | Levinson | 219/762 |
| 3,704,523 | A | | 12/1972 | Guerga et al. | |

(Continued)

*Primary Examiner* — Eric Stapleton
(74) *Attorney, Agent, or Firm* — Charles A. Greene

(57) ABSTRACT

Systems and methods for controlling drying of ceramic greenwares accounting for the load presented to a radio-frequency (RF) source of an RF applicator to reduce the risk of overheating greenware during drying. The method includes partially drying the greenware and then substantially drying the greenware with RF radiation. The RF radiation provided to an electrode region is controlled based on the number of greenware pieces within the electrode region at a given time. The system includes a control unit electrically connected to the electrode and configured to provide a select RF voltage to the electrode based on the number of greenwares within the electrode region. The system adjusts at least one input voltage from a power supply. The adjusted voltage is stepped-up, DC-rectified to form a plate voltage, and then converted by a high-frequency DC/AC convertor to the select high-frequency AC RF voltage needed to dry the greenwares without overheating.

20 Claims, 6 Drawing Sheets

(56) References Cited

U.S. PATENT DOCUMENTS

| | | | | | |
|---|---|---|---|---|---|
| 4,321,042 | A | * | 3/1982 | Scheicher | 433/201.1 |
| 4,439,929 | A | * | 4/1984 | Kitagawa et al. | 34/254 |
| 4,567,340 | A | * | 1/1986 | Latchum, Jr. | 219/701 |
| 4,687,895 | A | * | 8/1987 | Chitre et al. | 219/701 |
| 4,771,153 | A | * | 9/1988 | Fukushima et al. | 219/709 |
| 4,806,718 | A | * | 2/1989 | Seaborne et al. | 219/730 |
| 4,808,780 | A | * | 2/1989 | Seaborne | 219/730 |
| 4,956,530 | A | | 9/1990 | Koch | |
| 4,965,427 | A | * | 10/1990 | Seaborne | 219/759 |
| 4,968,865 | A | * | 11/1990 | Seaborne et al. | 219/759 |
| 5,098,620 | A | * | 3/1992 | Bradley et al. | 264/432 |
| 5,110,216 | A | * | 5/1992 | Wickersheim et al. | 374/122 |
| 5,183,787 | A | * | 2/1993 | Seaborne | 501/143 |
| 5,194,268 | A | * | 3/1993 | Bradley et al. | 425/84 |
| 5,227,600 | A | * | 7/1993 | Blake et al. | 219/762 |
| 5,408,074 | A | | 4/1995 | Warmbier et al. | |
| 5,560,287 | A | * | 10/1996 | Petelle et al. | 99/451 |
| 5,808,282 | A | * | 9/1998 | Apte et al. | 219/679 |
| 5,911,941 | A | * | 6/1999 | Rokhvarger et al. | 264/432 |
| 5,961,871 | A | * | 10/1999 | Bible et al. | 219/709 |
| 6,097,019 | A | * | 8/2000 | Lewis et al. | 219/750 |
| 6,132,671 | A | * | 10/2000 | Beall et al. | 264/630 |
| 6,157,014 | A | * | 12/2000 | Goranson | 219/700 |
| 6,172,346 | B1 | * | 1/2001 | Wroe | 219/681 |
| 6,222,170 | B1 | * | 4/2001 | Tucker et al. | 219/748 |
| 6,246,040 | B1 | * | 6/2001 | Gunn | 219/771 |
| 6,350,973 | B2 | | 2/2002 | Wroe et al. | 219/680 |
| 6,382,964 | B2 | * | 5/2002 | Sakamoto et al. | 432/171 |
| 6,462,320 | B1 | * | 10/2002 | Fuls et al. | 219/700 |
| 6,725,567 | B2 | * | 4/2004 | Yano et al. | 34/419 |
| 7,017,278 | B2 | | 3/2006 | Kato | |
| 7,087,874 | B2 | | 8/2006 | Ishikawa et al. | |
| 7,197,839 | B2 | | 4/2007 | Terazawa et al. | |
| 7,208,710 | B2 | * | 4/2007 | Gregoire et al. | 219/697 |
| 8,207,479 | B2 | * | 6/2012 | Ben-Shmuel et al. | 219/746 |
| 8,224,892 | B2 | * | 7/2012 | Bogatin et al. | 709/203 |
| 2002/0047009 | A1 | * | 4/2002 | Flugstad et al. | 219/771 |
| 2002/0084555 | A1 | * | 7/2002 | Araya et al. | 264/430 |
| 2002/0179596 | A1 | * | 12/2002 | Tracy et al. | 219/687 |
| 2003/0205571 | A1 | * | 11/2003 | Flugstad et al. | 219/497 |
| 2004/0240817 | A1 | * | 12/2004 | Hawtof et al. | 385/125 |
| 2005/0187094 | A1 | * | 8/2005 | Hayashi | 501/127 |
| 2005/0261795 | A1 | * | 11/2005 | Ghosh et al. | 700/118 |
| 2007/0235450 | A1 | * | 10/2007 | Quantrille et al. | 219/730 |
| 2007/0295716 | A1 | * | 12/2007 | Quantrille et al. | 219/678 |
| 2008/0023886 | A1 | * | 1/2008 | Adrian et al. | 264/489 |
| 2008/0303181 | A1 | * | 12/2008 | Holand et al. | 264/16 |
| 2010/0043248 | A1 | * | 2/2010 | Cervoni et al. | 34/254 |

* cited by examiner

SYSTEM AND METHOD FOR DRYING OF CERAMIC GREENWARE

CROSS REFERENCE TO RELATED APPLICATIONS

This application claims the benefit of priority to U.S. Provisional Application No. 61/130,505, filed on May 30, 2008.

FIELD

The present invention relates to drying ceramic greenware, and in particular relates to systems and methods for controlling the drying of ceramic greenware during manufacture.

BACKGROUND

As used herein, ceramic greenware, or more briefly greenware, refers to bodies comprised of ceramic-forming components that, upon firing at high temperature, form ceramic bodies. The greenware may include ceramic components, such as a mixture of various ceramic-forming components and a ceramic component. The various components can be mixed together with a liquid vehicle, such as water or glycol, and extruded with a formed shape, such as a honeycomb body. Immediately after extrusion, the greenware possesses some liquid content, such as water content, and typically at least some of the liquid must be removed, i.e. the greenware must be dried, prior to firing at high temperature that forms a refractory material.

The drying process must be carried out in a manner that does not cause defects (e.g., a change in shape, cracks, etc.) to the greenware. Such defects tend to occur when the greenware is overheated during drying.

SUMMARY

One aspect of the invention is a method of drying a piece of ceramic greenware comprising a liquid at an original liquid content. The method includes exposing the piece to electromagnetic radiation at a first frequency sufficient to remove a first portion of the liquid from the piece. The method also includes exposing the piece to electromagnetic radiation at a second frequency, the second frequency being different than the first frequency, sufficient to remove a second portion of the liquid from the piece.

Another aspect of the invention is a method of drying pieces of ceramic greenware each comprising a liquid at an original liquid content. The method includes exposing the pieces to microwave energy sufficient to remove a first portion of the liquid from the pieces and then exposing the pieces to radio-frequency (RF) energy sufficient to remove a second portion of the liquid from the pieces by passing a number of the pieces through an electrode region adjacent an electrode, wherein the electrode provides an amount of RF power in the electrode region based on the number of pieces in the electrode region.

Another aspect of the invention is a RF source for a RF applicator for controlling RF drying of pieces of ceramic greenware. The RF source comprises a power supply having three source lines that initially carry respective alternating current (AC) source voltages $V_1$, $V_2$ and $V_3$. The RF source also includes at least one silicon-controlled rectifier (SCR) operably connected to at least one of the power supply source lines and adapted to regulate at least one of the source voltages. A step-up transformer is operably coupled to the power supply and/or the SCR and is configured to receive the source voltages, including the at least one regulated source voltage, and is configured to generate therefrom a stepped-up AC transformer voltage $V_T$. A rectifier is configured to receive the AC transformer voltage and form a direct current (DC) rectified plate voltage $V_R$. A high-frequency DC/AC converter is configured to receive the DC rectified voltage and form a high-frequency AC RF voltage $V_{RF}$. An electrode is configured to receive the RF voltage and to generate RF energy in an electrode region wherein the pieces are subject to an amount of the RF energy that corresponds to the RF voltage. A programmable logic controller (PLC) is operably coupled to the SCR and is configured to cause the SCR to control at least one of the source voltages based on a number of pieces within the electrode region so as to control the plate voltage in order to control the RF voltage.

Another aspect of the invention is a method of drying pieces of ceramic greenware. The method includes partially drying the pieces. The method then includes substantially drying the pieces with RF energy from a RF source by passing the pieces through an electrode region of the RF source and varying the amount of RF energy in the electrode region based on the number of pieces in the electrode region. The RF source includes an electrode electrically coupled to a control unit configured to change an amount of a plate voltage provided to the electrode as a RF voltage based on the number of pieces in the electrode region.

These and other advantages of the invention will be further understood and appreciated by those skilled in the art by reference to the following written specification, claims and appended drawings.

DETAILED DESCRIPTION

Reference is now made in detail to the present preferred embodiments of the invention, examples of which are illustrated in the accompanying drawings. Whenever possible, the same reference numbers and symbols are used throughout the drawings to refer to the same or like parts.

Ceramic greenware can be formed by extruding a plasticized batch comprising ceramic-forming components, or ceramic precursors, through a die, such as a die that produces a honeycomb structure, to form a formed extrudate of the ceramic-forming material. The extrudate exiting the extruder is cut transversely to the direction of extrusion to form a piece. The piece may itself be transversely cut into shorter pieces; in some cases the longer piece is referred to as a "log." Extruded pieces of greenware contain a liquid vehicle such as water or glycol, which may be for example 10-25% by weight, and the greenware needs to be dried (i.e., the liquid vehicle removed) on the way to forming the final product.

The greenware can be placed on trays or supports and then sent through an oven or "applicator." Microwave (MW) applicators apply microwave radiation, as used herein corresponding to electromagnetic radiation in the frequency range of 900-2500 MHz. RF applicators apply RF (radio-frequency) radiation, as used herein corresponding to electromagnetic radiation in the frequency range of 20 to 40 MHz. Both MW and RF radiation is absorbed by the greenware. The liquid can thus be driven off by the radiation, leaving a dry (or drier) piece of greenware.

The greenware can be made up of material(s) transparent to MW and RF radiation, as well other materials that are not, i.e. MW susceptible materials such as graphite, as found, for example, in at least some batches and greenware that form aluminum titanate or "AT". Greenware containing MW susceptible material is more prone to the occurrence of hot spots during drying.

The systems and methods disclosed herein reduce the occurrence and/or intensity of any undesired localized heating, or hot spots, that result from drying greenware to the extent that is sufficient for preparing the greenware to be fired at high temperature, unlike known methods which provide drying by, for example, microwave drying to the fully dried state in which the greenware is ready to be fired at high temperature, wherein even if the overall moisture content of a piece of greenware is reduced to an acceptably dry level, the already-dried areas in the piece continue to heat up, possibly leading to cracking of the piece.

Figure 1A:
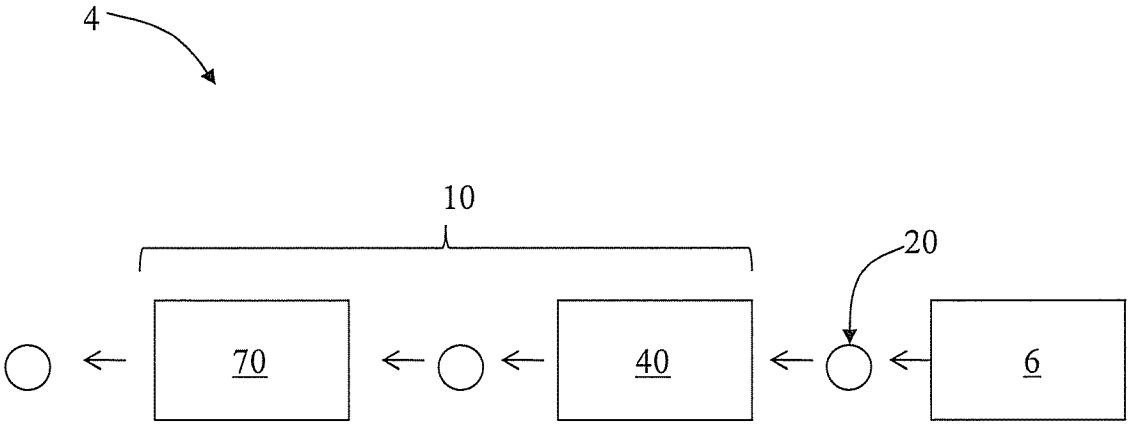
FIG. 1A is a schematic diagram of an example ceramic greenware forming system that includes an extruder followed by a two-step drying system.

FIG. 1A is a schematic diagram of an exemplary greenware forming system 4 that includes an extruder 6 followed by a two-step drying system 10 that includes a microwave (MW) dryer or "applicator" 40 followed by a radio-frequency (RF) dryer or "applicator" 70.

Figure 1B:
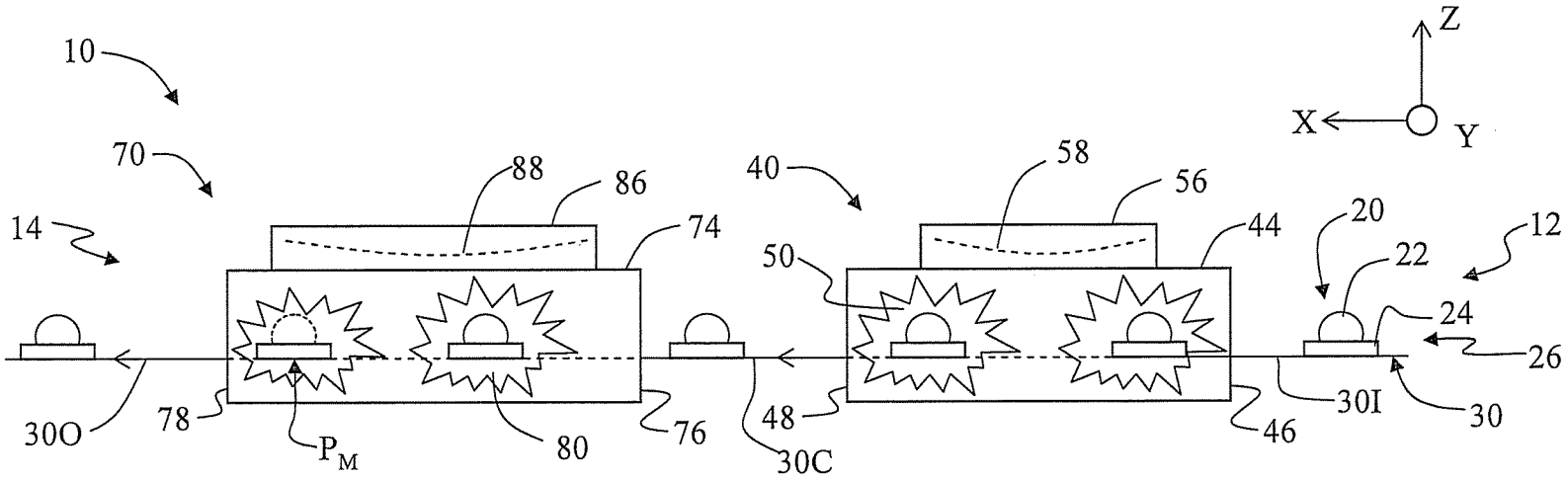
FIG. 1B is a schematic side view of an example of the two-step drying system of the system of FIG. 1A for performing a two-step drying process on the extruded greenwares.

FIG. 1B is a schematic side view of an example two-step drying system 10 of system 4 of FIG. 1A. Two-step drying system 10 uses electromagnetic radiation of two different frequencies (MW and RF) for performing a two-step drying process to dry the extruded greenware 20. Greenware 20 is shown in the form of extruded pieces of greenware 22 supported in trays 24. When pieces 22 are initially extruded by extruder 6, they have a liquid (e.g., water) content (e.g., 10% to 25% by weight) and so need to be dried. Pieces 22 can be generally cylindrical and in exemplary embodiments have a length of 23 to 38 inches and a diameter of about 5 inches, although other sizes and shapes can be accommodated. Corresponding exemplary trays 24 are 9" wide and are spaced apart with relatively small gaps 25 of 1 to 10 inches (see FIG. 2, where the relative size of gap 25 is exaggerated for the sake of illustration).

The greenware 20 can be manufactured by extruding ceramic-forming material via extruder 6, cutting the extrudate into pieces 22, and then performing drying and firing steps. After firing, the greenware piece transforms into a body comprising ceramic material, such as cordierite, and has a honeycomb structure with thin interconnecting porous walls that form parallel cell channels longitudinally extending between end faces, as disclosed in U.S. Pat. No. 2,884,091, U.S. Pat. No. 2,952,333, U.S. Pat. No. 3,242,649, U.S. Pat. No. 3,885,997 and U.S. Pat. No. 5,403,787 which patents are incorporated by reference herein. Exemplary inorganic batch component mixtures suitable for forming cordierite-based bodies are disclosed in U.S. Pat. No. 5,258,150; U.S. Pat. Pubs. No. 2004/0261384 and 2004/0029707; and U.S. Pat. No. RE 38,888, all of which are incorporated by reference herein.

Other exemplary ceramic bodies comprised of AT-based ceramic materials are discussed in U.S. Pat. No. 7,001,861, U.S. Pat. No. 6,942,713, U.S. Pat. No. 6,620,751, and U.S. Pat. No. 7,259,120, which patents are incorporated by reference herein. Such AT-based bodies are used as an alternative to cordierite and silicon carbide (SiC) bodies for high-temperature applications, such as automotive emissions control applications. The systems and methods disclosed herein apply to any type of greenware 20 amenable to RF drying techniques.

With continuing reference to FIG. 1B, drying system 10 has an input end 12 and an output end 14. Cartesian coordinates are shown for the sake of reference, with the Y-axis pointing out of the paper. Pieces 22 of greenware 20 in trays 24 are conveyed in a greenware queue 26 along a conveyor system 30 having one or more conveyor sections, namely an input section 30I, a central section 30C and an output section 30O. Pieces 22 are conveyed in the X-direction by conveyor system 30 so as to travel sequentially through MW applicator 40 and then RF applicator 70.

Figure 2:
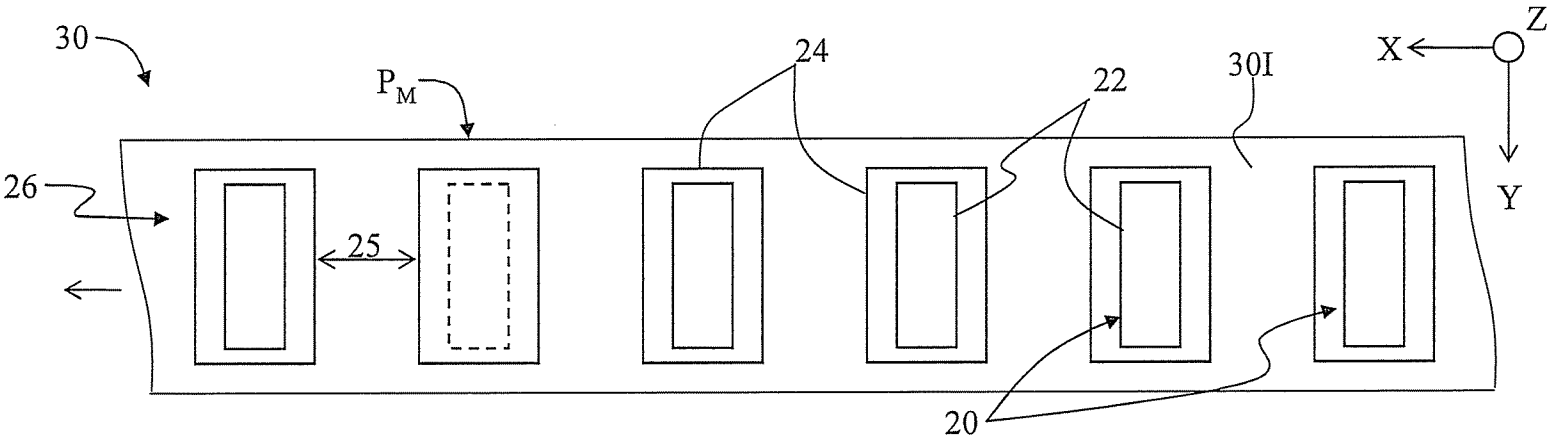
FIG. 2 is a close-up top-down view of the greenware queue showing a "missing" greenware in phantom at a "missing greenware" position ($P_M$)

FIG. 2 is a close-up top-down view of greenware queue 26 showing in phantom a "missing" piece 22 at a "missing piece" position $P_M$. The missing piece position $P_M$ is also shown in FIG. 1B. Note that position $P_M$ moves in the X-direction as conveyor system 30 moves piece 22 through RF dryer 10.

MW applicator 40 includes a housing 44 with input and output ends 46 and 48, an interior 50, and a MW source 56 that generates microwave radiation ("microwaves") 58. In an example embodiment, microwaves (or "microwave energy" or "microwave radiation") 58 have a frequency $f_{MW}$ in the frequency range from about 900-2500 MHz. RF applicator 70 includes a housing 74 with input and output ends 76 and 78, an interior 80, and a RF source 86 that generates radio waves (or "RF energy" or "RF radiation") 88. In an example embodiment, radio waves 88 have a frequency $f_{RF}$ in the frequency range from about 20 to 40 MHz. In an example embodiment, the MW radiation and RF radiation have frequencies that differ by more than 800 MHz, while in another example embodiment the frequencies differ by more than 800 MHz and not more than 3000 MHz.

In the general operation of drying system 10, cut pieces 22 of greenware 20 extruded from extruder 6 (FIG. 1A) are placed in trays 24 and conveyed via input conveyor section 30I to drying system input end 12. Pieces 22 are preferably aligned at input end 12 and then conveyed into interior 50 of MW applicator 40, where they are exposed to microwave energy 58 as they pass underneath MW source 56. In an example embodiment, the microwave energy 58 and the time over which pieces 22 are exposed to the microwave energy are selected so that the piece is partially but not completely dried upon leaving MW applicator 40 at its output end 48. By completely dried, we mean a first portion of the liquid has been removed so that the moisture content has been reduced to a level acceptable for firing of the piece at high temperature in order to form the ceramic material that makes up the ceramic body. In an example embodiment, pieces 22 are 75% dried upon leaving MW applicator 40. In respective example embodiments, pieces 22 are dried by more than 50% and more than 75% by MW applicator 40. In an example embodiment, pieces 22 contain more than 10 wt % water upon exiting MW applicator 40. In an example embodiment, the first portion of the liquid removed is between 40% and 80% of the original liquid content.

Pieces 22 are then conveyed to input end 76 of RF applicator 70 via central conveyor section 30C and enter interior 80 where they are exposed to RF energy 88 as they pass underneath RF source 86. The partially dried pieces 22 are substantially (i.e., completely or nearly completely) dried when they exit RF applicator at exit end 78 via output conveyor section 30O by removing a second portion of the liquid. In an example embodiment, pieces 22 contain less than 2 wt % water upon exiting RF applicator 70. In an example embodiment, the second portion of the liquid removed is greater than 0% and less than 60% of the original liquid content. In another example embodiment, the second portion of the liquid removed is between 10% and 40% of the original liquid content.

As disclosed herein, only partial drying of the piece is performed by exposing the piece to MW radiation. The pieces are not completely dried using MW applicator 40 because microwave drying can cause "hot spots" on the greenware that can damage the piece, particularly for greenware that contains a microwave-susceptible material, such as graphite. There is also the potential for overheating the pieces when an applicator is partially loaded versus fully loaded because the amount of energy available in the applicator tends to be a function of the load presented by greenwares. Partial loading conditions occur regularly when, for example, pieces are removed from the queue into the applicator, for example if they fail to meet specification. Partial loading conditions also lead to "excessive energy absorption" to the pieces adjacent to the gap, so that if a piece is missing, the excessive energy absorption does occur, resulting in greater radiation (or a different distribution of radiation) incident on the piece. MW radiation also does not penetrate ceramic-based greenwares 20 as deep as RF radiation. Consequently, we have found it beneficial to use a two-step drying process wherein pieces 22 are only partially dried by removing a first portion of the liquid (e.g., using MW radiation 58) and then completely dried by removing substantially all of the remaining (second) portion of the liquid using RF radiation 88.

We also discovered that when using a prior art RF applicator 70 in a two-step drying system 10, the partially dried pieces 22 that exited from the MW applicator 40 would often overheat when subsequently further dried in RF applicator 70. Overheating occurred most often when the load on RF generator 86 changed due to transient conditions within RF applicator interior 80, and in particular when pieces 22 were missing from greenware queue 26, as indicated by missing piece position $P_M$ in RF interior 80 (see also FIG. 2). Missing pieces occur when, for example, a given piece is removed from greenware queue 26 during inspection, or when the upstream extrusion process is interrupted (e.g., to change an extrusion die or other process interruption). This results in a delay of pieces 22 and trays 24 going to the two-step dryer system 10 or one or more greenware trays 24 remaining unfilled as conveyor system 30 continues to shepherd pieces 22 and the one or more empty trays 24 from the extruder to the two-step dryer system 10. The overheating of pieces 22 during RF drying resulted in damaged pieces that reduced the throughput of two-step applicator system, leading to increased product costs and diminished process stability.

RF Source with Plate Voltage Control

The above RF overheating problems led the inventors to develop a RF source 86 with voltage control so that RF applicator 70 can provide a more consistent power per greenware 20 for more consistent drying.

Figure 3A:
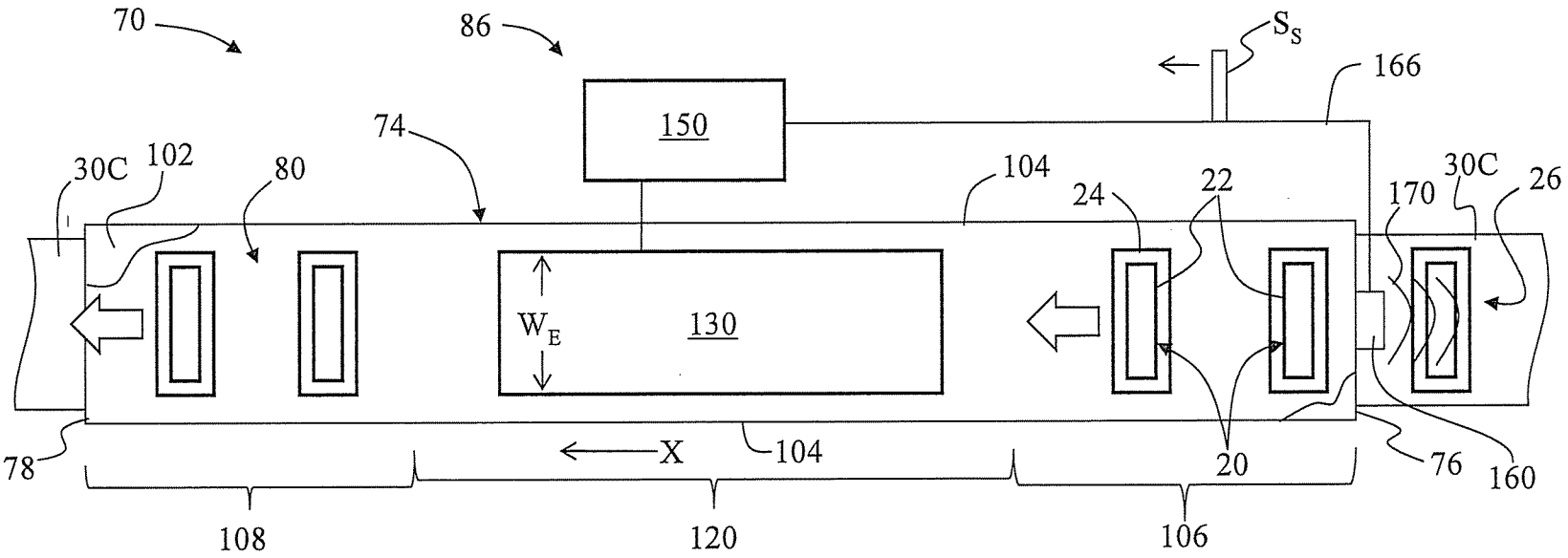
FIG. 3A is a schematic top-down view of an example embodiment of RF applicator that includes a RF source with voltage control according to the present invention.
Figure 3B:
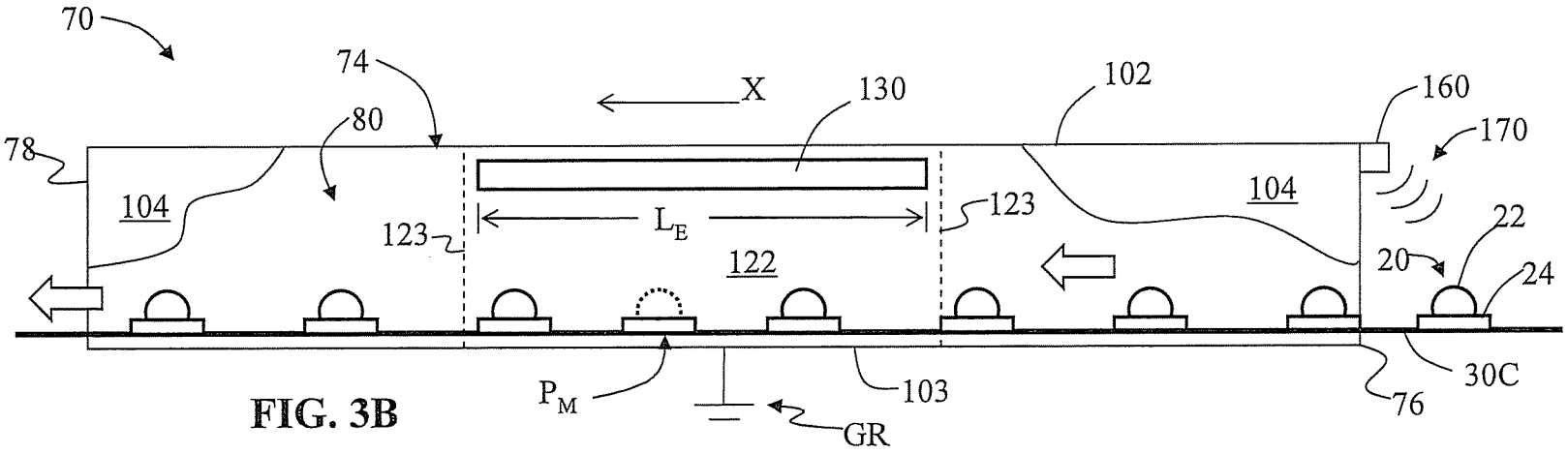
FIG. 3B is a schematic side view of the RF applicator of FIG. 3A.

FIG. 3A is a schematic top-down view of an example embodiment of RF applicator 70 that utilizes a RF source 86 with voltage control according to the present invention. FIG. 3B is a schematic side view of the RF applicator of FIG. 3A. Housing 74 of RF applicator 70 includes a top 102, a bottom 103 and sides 104. RF applicator 70 includes an entrance portion or "entrance vestibule" 106 at input end 76 and an exit portion or "exit vestibule" 108 at output end 78. Entrance and exit vestibules 106 and 108 lead to a central region 120 that includes a rectangular-shaped conducting plate-type electrode 130 arranged within interior 80 adjacent housing top 102 and spaced apart therefrom (e.g., by about 4 feet). In an example embodiment, entrance and exit vestibules 106 and 108 are about 8 feet in length.

Figure 4:
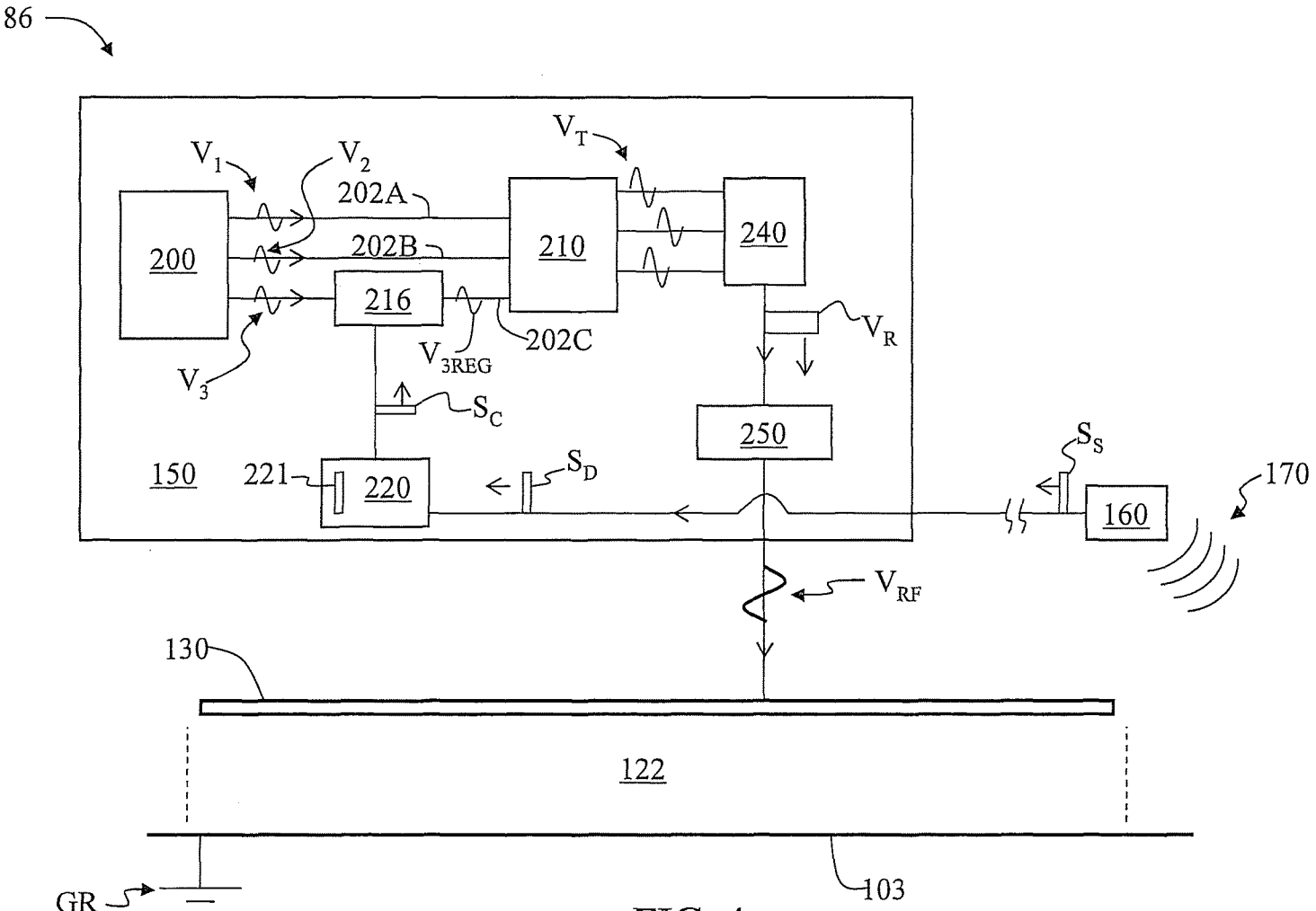
FIG. 4 is a schematic diagram of an example embodiment of the RF source of FIG. 3A that includes a control unit configured to vary the plate voltage $V_R$ so as to control the RF voltage $V_{RF}$ provided to the electrode.

In an example embodiment, electrode 130 has a length $L_E$=15 feet and a width $W_E$=4 feet. A portion of bottom 103 of housing 74 directly beneath electrode 130 is electrically grounded via electrical ground GR and serves as a "bottom electrode" that forms with electrode 130 a large parallel-plate capacitor in central region 120. Electrode 130 is electrically connected to a control unit 150 that controls the operation of RF applicator 70 and in particular provides the voltage control capability for RF source 86. An example control unit 150 is shown in FIG. 4 and is discussed in more detail below.

Control unit 150 provides a RF-frequency AC voltage signal $V_{RF}$ ("RF voltage") to electrode 130. This results in a RF-varying electric field that is substantially contained within a sub-region 122 ("electrode region") of central region 120 underneath electrode 130. Electrode region 122 has a length essentially the same as electrode length $L_E$ as indicated by vertical dashed lines 123. Electrode region 122 is where the RF drying of greenwares 20 takes place.

Control unit 150 is configured to control a DC "plate voltage" $V_R$, which directly controls the amount (amplitude) of (AC) RF voltage $V_{RF}$ applied to electrode 130 to account for the load placed on the electrode based on the number of pieces 22 in electrode region 122 at any given time. In an example embodiment, the number of pieces 22 in electrode region 122 is determined by a sensor 160 (e.g., an optical sensor) arranged at RF applicator entrance and operably connected to control unit 150 via a communication link 166, which is shown schematically as a wire link but can also be a wireless link. Sensor 160 uses signals 170 (e.g., optical signals) to determine the number of pieces 22 in greenware queue 26 as they enter entrance vestibule 106 and make their way to electrode region 122. In an example embodiment, control unit 150 is operably coupled to and controls the operation of central conveyor section 30C and so knows the speed of the conveyor and the distance pieces 22 need to travel from RF applicator entrance 76 to electrode region 122. Control unit 150 also knows the length of electrode region 122 and thus the amount of time it takes for each piece 22 to transit the electrode region 122.

RF Source Control Unit

Without RF power control, the plate voltage $V_R$ (and thus the RF Voltage $V_{RF}$ applied to electrode 130) is constant regardless of the number of pieces 22 in electrode region 122. During transient conditions (applicator load, unload, tray gaps, etc.), there is less mass in electrode region 122 to absorb the set amount of RF energy 88 in the region so that pieces 22 overheat.

FIG. 4 is a schematic diagram of an example embodiment of RF source 86 of the present invention showing an example embodiment of control unit 150 configured to control the RF voltage $V_{RF}$ provided to electrode 130 to account for the number of pieces 22 in electrode region 122 at any given time.

Control unit 150 includes three-phase power supply 200 (e.g., 480V AC) with three lines 202A, 202B and 202C that carry initial AC source voltages $V_1$, $V_2$ and $V_3$. In an example embodiment, two of the lines 202A and 202B are provided directly to a step-up transformer 210, while the remaining line 202C includes a silicon-controlled rectifier (SCR) 216. A programmable logic controller (PLC) 220 that includes a PLC register 221 is operably connected to SCR 216 and controls the SCR to regulate (i.e., change or vary) the amount of voltage $V_3$ carried by line 202C, which also is provided to step-up transformer 210. Step-up transformer 210 steps up the voltage provided thereto by transformer voltages $V_1$, $V_2$ and $V_{3REG}$ to form an AC transformer output voltage $V_T$. The transformer output voltage $V_T$ is fed to a rectifier 240, which rectifies the AC voltage $V_T$ to form DC plate voltage $V_R$. In an example embodiment, plate voltage $V_R$ is in the range from 8 KV to 15 KV. Plate voltage $V_R$ is shown in FIG. 5A in a plot of voltage vs. time.

Plate voltage $V_R$ is provided to a DC/AC converter 250, which converts this DC voltage into a high-frequency AC RF voltage $V_{RF}$. In an example embodiment, DC/AC converter 250 is an oscillator circuit that includes an oscillator tube (not shown). It is noted here that one or more of the components of controller unit 150 can reside outside of the unit and are shown as included within the unit for the sake of illustration. In a preferred embodiment, DC/AC converter 250 is a high-frequency DC/AC converter.

In a typical three-phase power supply, the source voltages $V_1$, $V_2$ and $V_3$ are equal and the output voltage is cycled between output lines 202A, 202B and 202C. In control unit 150, PLC 220 controls the SCR output voltage $V_3$ via a control signal $S_C$, thereby controlling the total (three-phase) voltage reaching step-up transformer 210. This in turn ultimately controls the amount of plate voltage $V_R$ and thus the amount of RF voltage $V_{RF}$, which controls the overall amount of RF energy 88 provided by electrode 130 in electrode region 122.

Figure 5B:
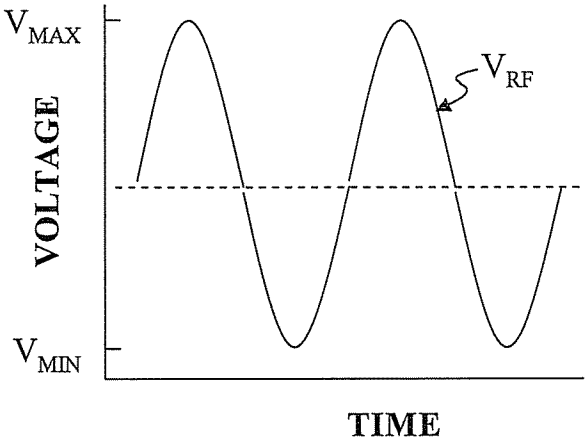
FIG. 5B is a plot of voltage versus time for the RF voltage $V_{RF}$ formed from the DC-rectified voltage $V_R$ and provided to the electrode.
Figure 5A:
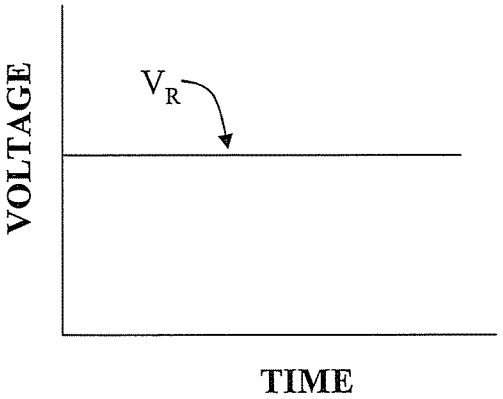
FIG. 5A is a plot of voltage versus time for the DC-rectified plate voltage $V_R$ formed from AC transformer voltage $V_T$.

FIG. 5B is a voltage vs. time plot that shows the RF voltage $V_{RF}$ as varying between maximum and minimum voltages $V_{MAX}$ and $V_{MIN}$. If additional voltage regulation is needed to provide a wider range of plate voltages $V_R$ to achieve a greater range for RF voltage $V_{RF}$, additional SCRs 216 can be placed on one or both of output lines 202A and 202B to further control the amount of voltage reaching step-up transformer 210.

In order to control RF voltage $V_{RF}$, the number of pieces 22 in electrode region 122 at any given time must be determined. As discussed above, sensor 160 uses signals 170 to determine the number of pieces 22 in greenware queue 26 as the pieces enter entrance vestibule 106 and make their way to electrode region 122. Before entering RF applicator 70, each applicator tray 24 and piece 22 (if present) is captured when exiting input conveyor section 30I and is aligned by central conveyor section 30C at applicator entrance 76. When tray 24 is released to move into RF applicator 70, piece 22 (or lack thereof) is detected and counted as it enters entrance vestibule 106 by sensor 160 sending a sensor signal Ss to PLC 220. PLC 220 receives sensor signal SS and in response thereto changes a bit in PLC register 221 in the control code for the RF applicator, which causes PLC control signal $S_C$ to make SCR 216 increase or decrease output voltage $V_3$. Conveyor speeds of the input and central conveyor sections 30I and 30C are known and are used to calculate the position of piece 22 over time. Example conveyor speeds are 10 to 35 inches per minute, so that in an example embodiment pieces 22 can reside in electrode region 122 for a time ranging from about 5 to about 15 minutes.

As tray 24 is moved by central conveyor section 30C in the X-direction, the bit in PLC register 221 indicating the position of piece 22 is incremented, allowing the piece's position to be tracked as it transits RF applicator interior 80. This process is repeated for every piece 22 that enters RF applicator 70 so that the number $N_P$ of pieces 22 and their corresponding positions in the RF applicator interior 80 are known at any given time. In particular, the positions of pieces 22 within electrode region 122 are tracked so that the plate voltage $V_R$ can be adjusted to provide an appropriate amount of RF energy to electrode region 122 via electrode 130. In an example embodiment, each piece 22 presents a select load to electrode 130, and the plate voltage $V_R$ is changed in corresponding select increments $\Delta V_R$ based on the select load.

Set Points and Parameters

A number of set points and parameters are used to control the amount of RF power P provided by electrode 130, which is determined by the RF voltage $V_{RF}$, which is in turn determined by the plate voltage $V_R$. It is assumed here that $P=\epsilon(V_R)(i_R)$ where $i_R$ is the plate current and $\epsilon$ is an efficiency factor. In an example embodiment, the plate current $i_R$ ranges from 1 to 10 Amperes (depending on the load), and the efficiency factor $\epsilon$ ranges from 60% to 80%.

There are four main operator-controlled set points, which are as follows:

$P_{MIN}$=the minimum RF power, which is the power applied when electrode region 122 is empty and until the number of pieces $N_P$ reaches a minimum number $N_{MIN}$ of pieces in the electrode region;

$P_{MAX}$=the maximum RF power, which is the power applied when the number of pieces $N_P$ in the electrode region is equal to or greater than a maximum number $N_{MAX}$ of pieces in the electrode region;

$N_{MIN}$=the minimum number of pieces in the electrode region required to start the power ramp sequence to generate an increase in RF power P; and $N_{MAX}$=the maximum number of pieces needed in the electrode region before the maximum RF power $P_{MAX}$ is applied.

The main parameters used to establish the above-identified set point values are: the RF applicator feed rate, the RF applicator conveyor speed, the incoming piece dryness, and the measured piece temperatures. These parameters are inputted, provided to or otherwise detected by PLC 220.

There are two modes of applying RF power: a "power ramp-up mode" where the amount of applied RF power is incremented upward, and a "power ramp-down mode" where the amount of applied RF power P is decremented.

In power ramp-up mode, when $N_P=N_{MIN}$ is reached as the RF applicator begins to be loaded with pieces 22, power ramp is applied incrementally as each additional piece enters the applicator. The incremental increase in RF power $\Delta P_I$ is calculated as:

$$\Delta P_I=(P_{MAX}-P_{MIN})/(N_{MAX}-N_{MIN}).$$

Once the piece count reaches $N_{MAX}$ and the RF power $P=P_{MAX}$, the RF applicator continues to output $P_{MAX}$ as long as the piece count $N_P$ in the RF applicator is greater than or equal to the $N_{MAX}$ set point.

There are two forms of power ramp-down mode: small gap and large gap modes. During small gap mode, when the piece count $N_P$ in RF applicator 70 drops below the $N_{MAX}$ set point as the RF applicator is unloaded or during small gaps (e.g. missing pieces 22), the RF power P is decremented incrementally by $\Delta P_I$ as previously defined. During large gap mode, which is when no pieces are loaded for at least 10 pieces or $N_P<N_{max}$ and pieces are exiting the RF applicator, the plate voltage decrement $\Delta P_D$ is calculated by:

$$\Delta P_D=[(P_{MAX}-P_{MIN})Q]/(N_{MAX}-N_{MIN}).$$

where Q is the ramp down factor that is determined by process experimentation based on piece temperatures and dryness out of the RF Dryer, currently set at 0.5. The parameter Q is adjustable in the PLC code.

During the large gap mode, the RF power P is calculated by $$P=(\Delta P_D)N_P+P_{MIN}$$

If the applicator begins to load during the ramp down sequence, one or more pieces 22 entering the RF applicator 70 will cause control unit 150 to switch the mode to the power ramp-up mode.

Figure 6:
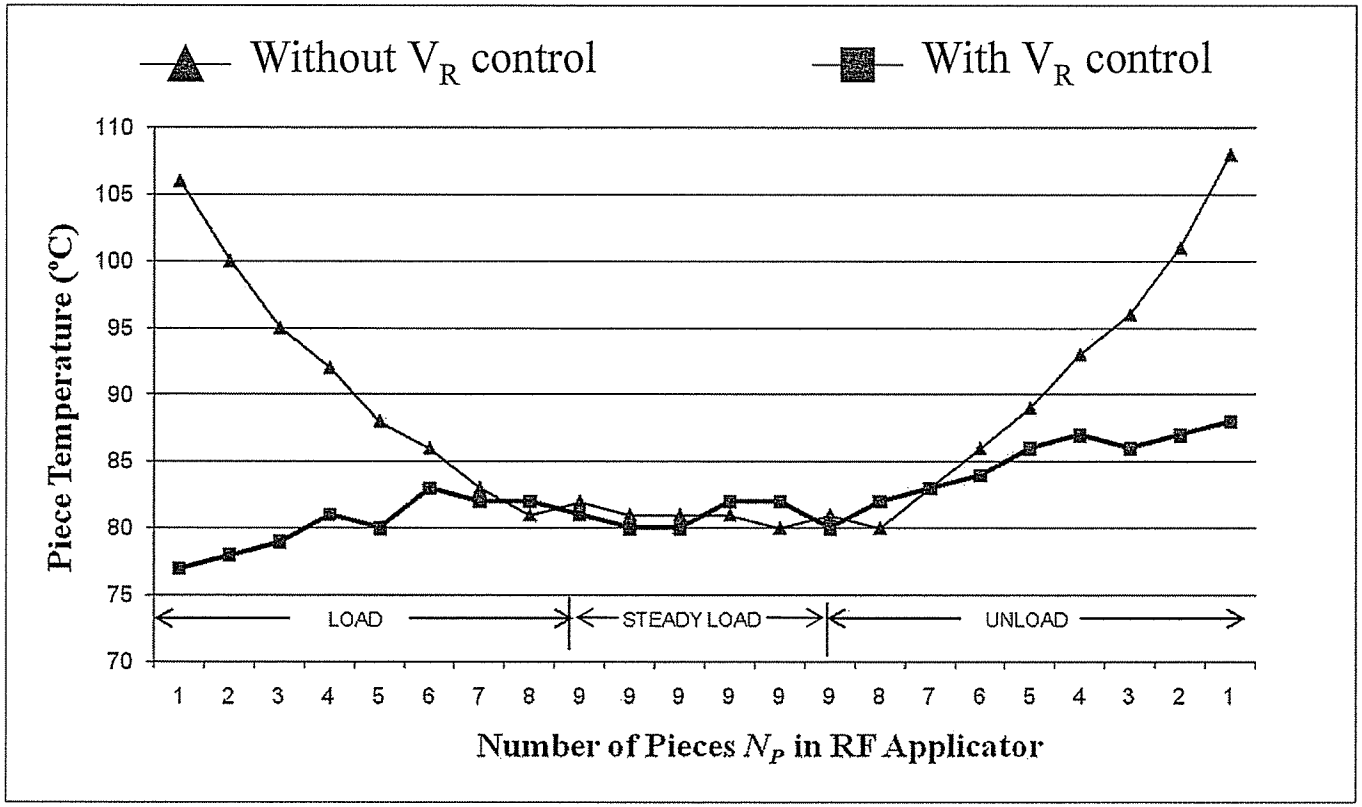
FIG. 6 is a plot of the measured temperature of pieces of greenware (22) versus the number of pieces $N_P$ in the electrode region for a RF applicator having a RF source that does not control the plate voltage $V_R$ as compared to a RF applicator that includes a RF source that controls the plate voltage according to the present invention.

FIG. 6 is a plot of the temperature of pieces 22 ("Piece Temperature") in ° C. in RF applicator 70 as a function of the number of pieces $N_P$ in the applicator with and without control of plate voltage $V_R$. The piece temperatures were measured using a pyrometer (not shown) located immediately following the RF applicator interior 80 along the conveyor travel. While the piece temperatures were about the same for a "steady load" (i.e., a constant number of pieces 22 in electrode region 122), the piece temperatures were much higher (by as much as 25° C.) during the piece "loading" and "unloading" phases when the number of pieces 22 in electrode region 122 varied and the plate voltage $V_R$ was not controlled as described above.

On the other hand, with control of plate voltage $V_R$, the piece temperatures during the loading and unloading phases remained within a reasonable level (e.g., about +/−8° C. or so) as compared to the piece temperatures in the "steady load" phase. The ability to control the piece temperature during RF drying by controlling the RF power P via controlling the RF voltage $V_{RF}$ by controlling the plate voltage $V_R$ allows for consistent drying conditions for pieces 22, which translates into fewer overheated pieces and thus fewer damaged pieces.

Thus, in one aspect, a method is disclosed herein of drying a piece of ceramic greenware comprising a liquid at an original liquid content, the method comprising: exposing the piece to electromagnetic radiation at a first frequency sufficient to remove a first portion of the liquid from the piece; and then exposing the piece to electromagnetic radiation at a second frequency, the second frequency being different than the first frequency, sufficient to remove a second portion of the liquid from the piece. The piece preferably contains material susceptible to the electromagnetic radiation at the first frequency. Preferably, the first and second frequencies differ by more than 800 MHz; in some embodiments, the first and second frequencies differ by more than 800 MHz and not more than 3000 MHz; in some embodiments, the first frequency is in the range of 900 MHz to 2500 MHz; in some embodiments, the second frequency is in the range of 20 MHz to 40 MHz. In some embodiments, the first portion of the liquid removed is between 40% and 80% of the original liquid content. In some embodiments, the second portion of the liquid removed is greater than 0% and less than 60% of the original liquid content; in some of these embodiments, the second portion of the liquid removed is between 10% and 40% of the original liquid content.

In another aspect, a method is disclosed herein of drying pieces of ceramic greenware each comprising a liquid at an original liquid content, the method comprising: exposing the pieces to microwave energy sufficient to remove a first portion of the liquid from the pieces, and then exposing the pieces to radio-frequency (RF) energy sufficient to remove a second portion of the liquid from the pieces by passing a number of the pieces through an electrode region adjacent an electrode, wherein the electrode provides an amount of RF power in the electrode region based on the number of pieces in the electrode region. In some embodiments, the exposing to the microwave energy reduces a liquid content of at least one of the pieces by more than 40%. In some embodiments, the exposing to the microwave energy reduces a liquid content of at least one of the pieces by more than 50%. In some embodiments, the exposing to the microwave energy reduces a liquid content of at least one of the pieces by more than 75%. In some embodiments, the method further includes tracking the number of pieces within the electrode region; in some of these embodiments, the method includes sensing the presence of each piece in the electrode region with a sensor prior to the piece entering the electrode region, and providing a sensor signal from the sensor to a controller for each sensed piece. In some embodiments, at least one of the pieces contains less than 2 wt % liquid after being exposed to the RF energy. In some embodiments, at least one of the pieces contains more than 10 wt % liquid prior to being exposed to the microwave energy and contains less than 2 wt % liquid after being exposed to the RF energy. In some embodiments, the method includes providing the amount of RF power by providing a rectified plate voltage ($V_R$), converting the plate voltage into a RF voltage ($V_{RF}$), and providing the RF voltage to the electrode; in some of these embodiments, each piece in the electrode region presents a respective load to the RF electrode, and including changing the plate voltage in one or more increments in response to the load; in other embodiments, the plate voltage is in the range between 8 kV and 15 kV; in some embodiments, the method further includes changing the plate voltage by regulating at least one source voltage from a three-phase power source to provide at least one regulated source voltage; in some of these embodiments, the at least one regulated source voltage is regulated by using a silicon-controlled rectifier (SCR) controlled by a programmable logic controller (PLC); in other of these embodiments, the method further includes providing a plurality of source voltages, including the at least one regulated source voltage, to a step-up transformer so as to form a stepped-up AC transformer voltage, providing the transformer voltage to a rectifier to form the plate voltage, and providing the rectified plate voltage to a high-frequency DC/AC converter so as to form the RF voltage. In some embodiments, the method includes passing the pieces through the electrode region by a conveyor having a speed, and providing the conveyor speed to the PLC to track the number of pieces in the electrode region at a given time.

In another aspect, a radio-frequency (RF) source is disclosed herein for an RF applicator for controlling RF drying of pieces of ceramic greenware, the source comprising: a power supply having three source lines that initially carry respective AC source voltages V1, V2 and V3; at least one silicon-controlled rectifier (SCR) operably connected to at least one of the source lines and adapted to regulate at least one of the source voltages to provide at least one regulated source voltage; a step-up transformer operably coupled to the power supply and/or the SCR and configured to receive the source voltages, including the at least one regulated source voltage, and configured to generate therefrom a stepped-up AC transformer voltage VT; a rectifier configured to receive the AC transformer voltage and form a DC rectified plate voltage VR; a high-frequency DC/AC converter configured to receive DC rectified voltage VR and form a high-frequency AC RF voltage VRF; an electrode configured to receive the RF voltage VRF to generate RF energy in an electrode region wherein the pieces are subject to an amount of the RF energy that corresponds to the RF voltage VRF; and a programmable logic controller (PLC) operably coupled to the SCR and configured to cause the SCR to control at least one of the input voltages based on a number of pieces within the electrode region so as to control the plate voltage VR, in order to control the RF voltage VRF. In some embodiments, the source further includes a sensor operably coupled to the PLC and configured to detect a number of pieces of greenware entering the electrode region and in response thereto generate a sensor signal received by the PLC. In some embodiments, the plate voltage ranges from 8 kV to 15 kV. In another aspect, an RF applicator is disclosed herein comprising such RF source and a housing having a top and bottom portion, with the electrode arranged adjacent the top portion and wherein the bottom portion is beneath the electrode and is electrically grounded.

In another aspect, a method is disclosed herein of drying pieces of ceramic greenware, comprising: partially drying the pieces; and then substantially drying the pieces with RF energy from a RF source by passing the pieces through an electrode region of the RF source and varying the amount of RF energy in the electrode region based on the number of pieces in the electrode region; wherein the RF source includes an electrode electrically coupled to a control unit configured to change an amount of a plate voltage provided to the electrode as a RF voltage based on the number of pieces in the electrode region. In some embodiments, the method further includes tracking a number of pieces within the electrode region as a function of time. In some embodiments, each piece creates a select load to the RF electrode, and the method further comprises changing the plate voltage so as to change the RF voltage in corresponding select increments in response to said select load; in some of these embodiments, changing the plate voltage comprises regulating at least one of multiple input voltages provided by a power supply; in some embodiments, changing the plate voltage and RF voltage further comprises providing source voltages including the at least one regulated source voltage to a step-up transformer so as to form a stepped-up AC transformer voltage, providing the stepped-up AC transformer voltage to a rectifier to form the plate voltage as a DC rectified voltage, and providing the plate voltage to a high-frequency DC/AC converter so as to form the RF voltage.

It will be apparent to those skilled in the art that various modifications to the preferred embodiment of the invention as described herein can be made without departing from the spirit or scope of the invention as defined in the appended claims. Thus, it is intended that the present invention covers the modifications and variations of this invention provided they come within the scope of the appended claims and the equivalents thereto.

What is claimed is:

1. A method of drying a piece of ceramic greenware having a honeycomb structure and comprising a liquid at an original liquid content, the method comprising:

providing a piece of ceramic greenware having a honeycomb structure, comprising interconnecting walls that form parallel cell channels longitudinally extending between end faces;

exposing the piece to first electromagnetic radiation from a first electrode at a first frequency and a first power sufficient to remove a first portion of the liquid from the piece;

measuring the piece temperature; and then exposing the piece to second electromagnetic radiation at a second frequency and a second power, the second frequency being different than the first frequency, sufficient to remove a second portion of the liquid from the piece, wherein a sum of the first portion of the liquid and the second portion of the liquid is less than or equal to the original liquid content, wherein one of the second frequency and the second power is adjusted by a control unit operably connected to either the first electrode or the first and second electrodes, wherein the control unit uses the following set points for the second power: a minimum RF power, a maximum RF power, a minimum number of pieces in an electrode region, and a maximum number of pieces in the electrode region, wherein at least one of the set points is based on the measured piece temperature, and wherein the exposing to the first electromagnetic radiation reduces a liquid content of the piece by more than 75%.

2. The method of claim 1 wherein the piece contains material susceptible to the electromagnetic radiation at the first frequency.

3. The method of claim 1 wherein the first and second frequencies differ by more than 800 MHz.

4. The method of claim 1 wherein the first and second frequencies differ by more than 800 MHz and not more than 3000 MHz.

5. The method of claim 1 wherein the first frequency is in a range of 900 MHz to 2500 MHz.

6. The method of claim 1 wherein the second frequency is in a range of 20 MHz to 40 MHz.

7. The method of claim 1, wherein the first portion of the liquid removed is between 75% and 80% of the original liquid content.

8. The method of claim 1, wherein the second portion of the liquid removed is greater than 0% and less than 25% of the original liquid content.

9. The method of claim 8, wherein the second portion of the liquid removed is between 10% and 23% of the original liquid content.

10. A method of drying pieces of ceramic greenware each having a honeycomb structure and comprising a liquid at an original liquid content, the method comprising:

providing pieces of ceramic greenware each having a honeycomb structure, comprising interconnecting walls that form parallel cell channels longitudinally extending between end faces;

exposing the pieces to microwave energy sufficient to remove a first portion of the liquid from the pieces;

then measuring a temperature of at least one of the pieces; and then exposing the pieces to radio-frequency (RF) energy sufficient to remove a second portion of the liquid from the pieces by passing the pieces, a number of the pieces at a time, through an electrode region adjacent an electrode, wherein the electrode provides an amount of RF power in the electrode region based on the number of pieces in the electrode region and the measured temperature of at least one of the pieces, wherein the first portion of the liquid removed is between 40% and 80% of the original liquid content, and wherein the second portion of the liquid removed is between 10% and 40% of the original liquid content.

11. The method of claim 10, wherein the exposing to the microwave energy reduces a liquid content of at least one of the pieces by more than 40%.

12. The method of claim 10, wherein the exposing to the microwave energy reduces a liquid content of at least one of the pieces by more than 50%.

13. The method of claim 10, wherein the exposing to the microwave energy reduces a liquid content of at least one of the pieces by more than 75%.

14. The method of claim 10, further including tracking the number of pieces within the electrode region.

15. The method of claim 14, including sensing the presence of each piece in the electrode region with a sensor prior to the piece entering the electrode region, and providing a sensor signal from the sensor to a controller for each sensed piece.

16. The method of claim 10, wherein at least one of the pieces contains less than 2 wt % liquid after being exposed to the RF energy.

17. The method of claim 10, wherein at least one of the pieces contains more than 10 wt % liquid prior to being exposed to the microwave energy and contains less than 2 wt % liquid after being exposed to the RF energy.

18. A method of drying pieces of ceramic greenware each having a honeycomb structure, comprising:

providing a plurality of pieces of ceramic greenware each having a honeycomb structure of interconnecting walls that form parallel cell channels longitudinally extending between end faces;

drying the pieces to remove a first portion of liquid;

then measuring a temperature of at least one of the pieces; and then drying the pieces to remove a second portion of liquid with RF energy from a RF source by passing the pieces through an electrode region of the RF source and varying the amount of RF energy in the electrode region based on the number of pieces in the electrode region;

wherein the RF source includes an electrode electrically coupled to a control unit configured to change an amount of a plate voltage provided to the electrode as a RF voltage based on the number of pieces in the electrode region, wherein the control unit is configured to vary the RF voltage from the RF source to change the amount of the plate voltage using at least one set point based on the measured temperature of at least one of the pieces, wherein the first portion of liquid removed is between 40% and 80% of an original liquid content of the pieces, and wherein the second portion of the liquid removed is between 10% and 40% of the original liquid content of the pieces.

19. The method of claim 18, further including tracking a number of pieces within the electrode region as a function of time.

20. The method of claim 18, wherein each piece presents a select load to the RF electrode, and the method further comprises changing the plate voltage so as to change the RF energy in select increments corresponding to the number of pieces in the electrode region in response to said select load, wherein the control unit is configured to change the RF voltage from the RF source to change the amount of the plate voltage in response to the select load.

* * * * *